US006349717B1

(12) United States Patent
Thompson et al.

(10) Patent No.: US 6,349,717 B1
(45) Date of Patent: Feb. 26, 2002

(54) OVEN RACK SYSTEM HAVING CUTOUT AREA AND INSERT RACK

(75) Inventors: Joseph E. Thompson; Steven M. Schatz, both of Tipp City, OH (US); Carl R. Offutt, Loudon, TN (US); Franklin P. Hayba, Zephyrhills, FL (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/680,379

(22) Filed: Oct. 5, 2000

(51) Int. Cl.[7] ..... F24C 15/16
(52) U.S. Cl. ..... 126/337 R; 126/333; 211/153
(58) Field of Search ..... 126/337 R, 337 A, 126/339, 19 R, 21 R; 211/153; 99/450; D7/409, 402

(56) References Cited

U.S. PATENT DOCUMENTS

| | | | | | |
|---|---|---|---|---|---|
| 1,930,773 | A | * | 10/1933 | Saum | 211/153 |
| 1,997,432 | A | * | 4/1935 | Replogle | 211/153 |
| 2,169,763 | A | * | 8/1939 | Kucher | 211/153 |
| 2,352,345 | A | * | 6/1944 | Rundell | 211/153 |
| 2,875,016 | A | * | 2/1959 | Fry | 129/339 |
| 3,450,025 | A | * | 6/1969 | Fleming | 126/337 R |
| 4,651,713 | A | | 3/1987 | Ondrasik, II | 126/339 |
| 4,848,217 | A | | 7/1989 | Koziol | 99/426 |
| 4,922,079 | A | | 5/1990 | Bowen et al. | 219/415 |
| 4,942,862 | A | | 7/1990 | Alden et al. | 126/337 |
| 5,404,800 | A | | 4/1995 | Hsu | 99/426 |
| 5,447,146 | A | | 9/1995 | Nickerson | 126/339 |
| 5,507,398 | A | | 4/1996 | Miller | 211/153 |
| 5,651,597 | A | | 7/1997 | Oslin | 312/350 |
| D389,374 | S | | 1/1998 | Miller | D7/408 |
| 5,775,209 | A | | 7/1998 | Tiemann | 99/426 |
| D401,112 | S | | 11/1998 | Miller | D7/408 |
| 5,927,267 | A | | 7/1999 | McKenzie | 126/41 R |
| 6,097,981 | A | | 5/2000 | Peter et al. | 126/337 |

FOREIGN PATENT DOCUMENTS

| | | | |
|---|---|---|---|
| DE | 2451822 | 6/1976 | A47L/15/42 |
| DE | 2022270 | 5/1980 | |
| GB | 1352655 | 5/1974 | B04B/5/12 |
| GB | 2277678 A | 9/1994 | A47L/15/42 |

* cited by examiner

*Primary Examiner*—James C. Yeung
(74) *Attorney, Agent, or Firm*—Joel M. Van Winkle; Robert O. Rice; Stephen Krefman

(57) ABSTRACT

A rack system for an oven wherein the oven includes an oven cavity having top, bottom, rear and side walls, the side walls including a plurality of support runners arranged as associated pairs on the side walls of the oven cavity. The oven cavity has an open frontal portion and an associated width defined by the lateral distance spanning the side walls. The rack system including a lower rack having a width substantially equal to the width of the oven cavity such that the upper rack may be supported by one of the runner pairs provided on the side wall of the oven cavity. An upper rack assembly is provided having a width substantially equal to the width of the oven cavity, the upper rack being supported on one of the runner pairs provided on the side wall of the oven cavity. The upper rack includes a main rack and an insert rack. The main rack has a width substantially equal to the width of the oven cavity and has a platform area and a cutout area. The insert rack has an area substantially equal to the cutout area and is adapted to removably attach to the main rack and fit within the cutout area. The insert rack may be removed from the main rack such that large items having a height greater than the vertical distance between the lower an upper rack may be accommodated.

8 Claims, 5 Drawing Sheets

OVEN RACK SYSTEM HAVING CUTOUT AREA AND INSERT RACK

BACKGROUND OF THE INVENTION

1. Field of the Invention

The present invention pertains to the art of cooking appliances and, more particularly, to an oven rack system that includes a main rack having a cutout area which can receive and support an insert rack.

2. Discussion of the Prior Art

Ovens designed for household use in today's marketplace are generally provided with multiple elongated racks (typically two), each of which has a lateral dimension substantially equal to the width of the oven cavity in which it is adapted to be placed for supporting items to be cooked. The cavity itself is generally provided with side wall runners for supporting respective lateral ends of the racks and permitting vertical adjustability of the racks. The use of multiple racks allows for effective use of the oven cavity during cooking.

It is often the case, however, that multiple items need to be cooked simultaneously within an oven and the height of at least one of the items is such that only a single rack can be accommodated within the oven cavity. In other words, even if the two racks are spaced vertically a maximum permissible distance within the oven cavity, the item to be cooked could not be placed upon the lower rack due to interference with the upper rack. Under such circumstances, the upper rack must be entirely removed from the oven cavity, thereby leaving only the single rack to support each of the items to be cooked. Unfortunately, this obviously limits the available supporting area for the various items to be cooked such that effective use of the entire oven cavity for cooking is prevented.

It has been proposed in the art to mount a partial width oven rack within the oven cavity above a full width rack. An example of such an oven rack is disclosed in U.S. Pat. No. 6,067,981. Unfortunately, such an arrangement has various associated drawbacks. Conventional ovens are provided with two full width racks for supporting items within an oven cavity. This configuration is necessary to allow users to take full advantage of the oven cavity. Use of a partial width oven rack would require removal of the upper full width oven rack and replacement with the partial width oven rack. Such removal of one of the full width oven racks is awkward and undesirable. Moreover, the use of a partial width oven rack presents rack storage problems—when the partial width rack is not in use it must be stored in some location and when it is in use the removed full width oven rack must be stored in some location. Still another drawback of the partial width rack solution is that the rack requires special mounting tabs that fit in the slots formed into the oven cavity in addition to the conventional side runners provided for supporting full width oven racks. Moreover, even with the mounting tabs, partial width oven racks are limited in size and present problems with regard to stability and rack deflection under load due to the fact that partial width racks only have support along two adjacent sides.

SUMMARY OF THE INVENTION

The foregoing objects are achieved by a rack system for an oven wherein the oven includes an oven cavity having top, bottom, rear and side walls, the side walls including a plurality of support runners arranged as associated pairs on the side walls of the oven cavity. The oven cavity has an open frontal portion and an associated width defined by the lateral distance spanning the side walls. The rack system including a lower rack having a width substantially equal to the width of the oven cavity such that the lower rack may be supported by one of the runner pairs provided on the side wall of the oven cavity. An upper rack assembly is provided having a width substantially equal to the width of the oven cavity, the upper rack also being supported on one of the runner pairs provided on the side wall of the oven cavity. The upper rack includes a main rack and an insert rack. The main rack has a width substantially equal to the width of the oven cavity and has a platform area and a cutout area. The insert rack has an area substantially equal to the cutout area and is adapted so as to attach to the main rack and fit within the cutout area. The insert rack may be removed from the main rack such that large items, having a height greater than the vertical distance between the lower and upper rack, may be accommodated. The insert rack when removed, may be used as a trivet or cooling rack to support hot items on a countertop upon removal from the oven.

The present invention can be summarized even more concisely as a rack assembly for forming a support shelf for supporting articles in an oven enclosure. The rack assembly includes a main rack having a width substantially equal to the width of the oven enclosure. The main rack has a platform area and cutout area. An insert rack having an area substantially equal to the cutout area is adapted to be removably connected to the main rack and fit within the cutout area.

DETAILED DESCRIPTION OF THE PREFERRED EMBODIMENT

Figure 1:
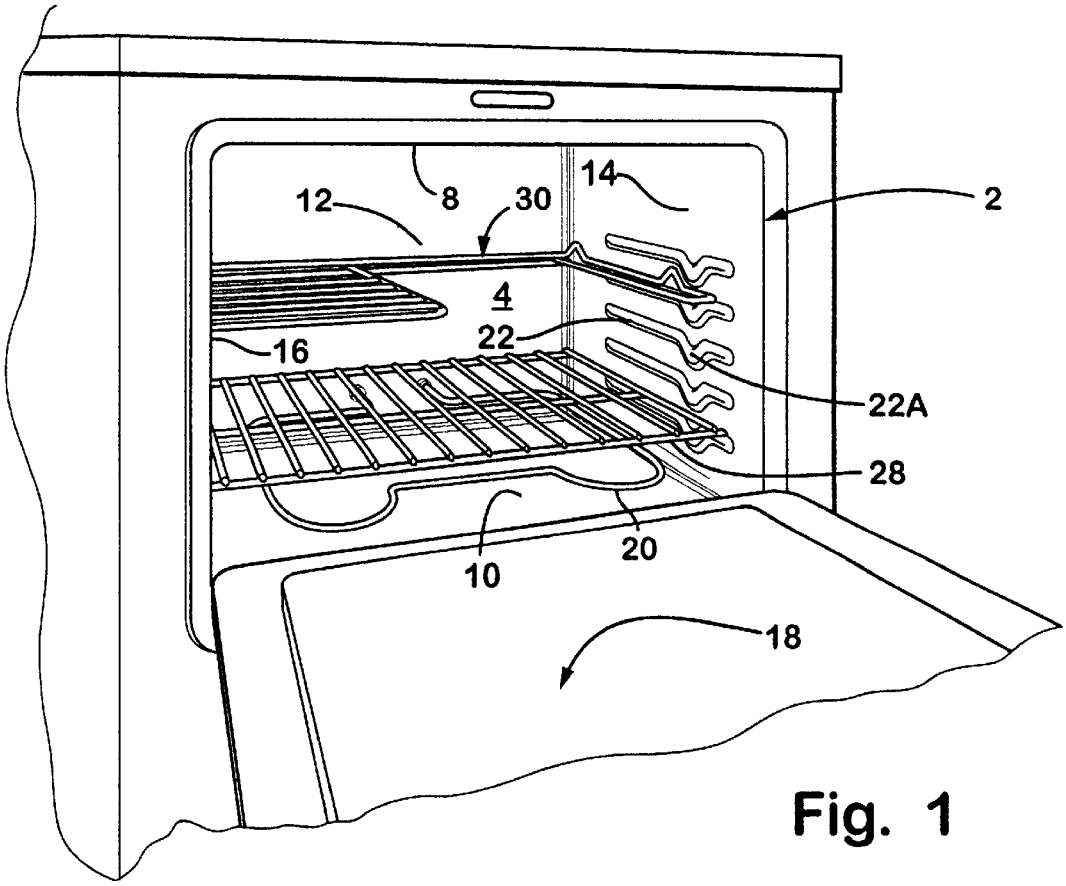
FIG. 1 is a partial perspective view of an oven incorporating an upper rack assembly according to the present invention.

With initial reference to FIG. 1, an oven associated with the present invention is generally indicated at 2. In a manner known in the art, oven 2 includes a cavity 4 defined by a top wall 8, a bottom wall 10, a rear wall 12 and side walls 14 and 16, respectively. Cavity 4 is adapted to be closed by means of a door 18. Although various types of heating sources can be utilized in connection with oven 2, in the preferred embodiment shown, an electric heating element 20 is provided adjacent to bottom 10 and a similar element (not shown) is provided adjacent to top 8 for broiling purposes.

In a manner also known in the art, side walls 14 and 16 are preferably provided with a plurality of fore-to-aft extending and vertically spaced runners, one of which is indicated at 22. Each of the runners 22 are arranged as associated pairs on the side walls 14 and 16 in order to support at least two oven racks. An elongated lower rack 28 is provided and extends across substantially the entire width of cavity 4. An elongated, upper rack 30 is also provided and likewise extends across substantially the entire width of the cavity 4. Of course, the elongated racks 28 and 30 can be supported upon any respective pair of the runners 22 such that elongated racks 28 can assume various vertical positions within cavity 4. Each of the runners 22 preferably includes a detent portion 22A that cooperates with a tab or the like (not labeled) provided on the elongated rack 28 and 30 in order to limit the movement of racks relative to cavity 4.

Turning now to FIGS. 2–6, details of a first embodiment of the upper rack can be described. As shown in these figures, the upper rack 30 can be seen to be a rack assembly including a main rack 32 and an insert rack 34. Both the main rack 32 and insert rack 34 are preferably constructed of metal wire, such an iron coated with nickel, but it should be realized that other constructions are possible within the scope of the invention. For example, the racks could be made out of sheet metal.

The main rack 32 is provided with a platform area or portion 36, a first side edge 38, a second side edge 40 and a cutout area or portion 42. The first side edge 38 forms a first support portion and the second side edge 40 forms a second support portion. In the embodiment shown, the platform area or portion 36 includes a pair of laterally spaced and generally parallel arranged sidebars 44 and 46 which are interconnected by a front crossbar 48, as well as a plurality of fore-to-aft spaced and laterally extending wire rails 50. The cutout area 42 is provided between the platform area 36 and the second side edge 40 and is free of any wires. The cutout area 42 is defined between the sidebar 46 and a cutout side bar 54.

To economically produce the main rack 32, a continuous frame wire 56 may be provided and bent into a shape to form the first side edge 38, a rear edge 58, the second side edge 40, the cutout side bar 54, the front crossbar 48 and the sidebar 46. In this way, the oven rack is formed with a minimum of welding. Separate wires form the sidebar 44 and the laterally extending wire rails 50. A full width rear wire 62 may be provided along the rear edge in addition to a cutout rear cross wire 64. The full width rear wire 62 and the partial width rear wire 64 are welded to opposite sides of the front-to-back side bars 46 and 54 to form a rear beam extending across the rear of the main rack 32 that increases the strength of the main rack 32.

The insert rack 34 may be formed from a frame wire 68 which is formed into a rectangular shape having a front edge 70, a first side edge 72, a rear edge 74 and a second side edge 76. A plurality of wire cross rails 78 extend between the first side edge 72 and the second side edge 76. The insert rack is further provided with a plurality of locating legs 80. The locating legs may be formed as part of the end portions of the front most and rear most cross rails 78.

Figure 2:
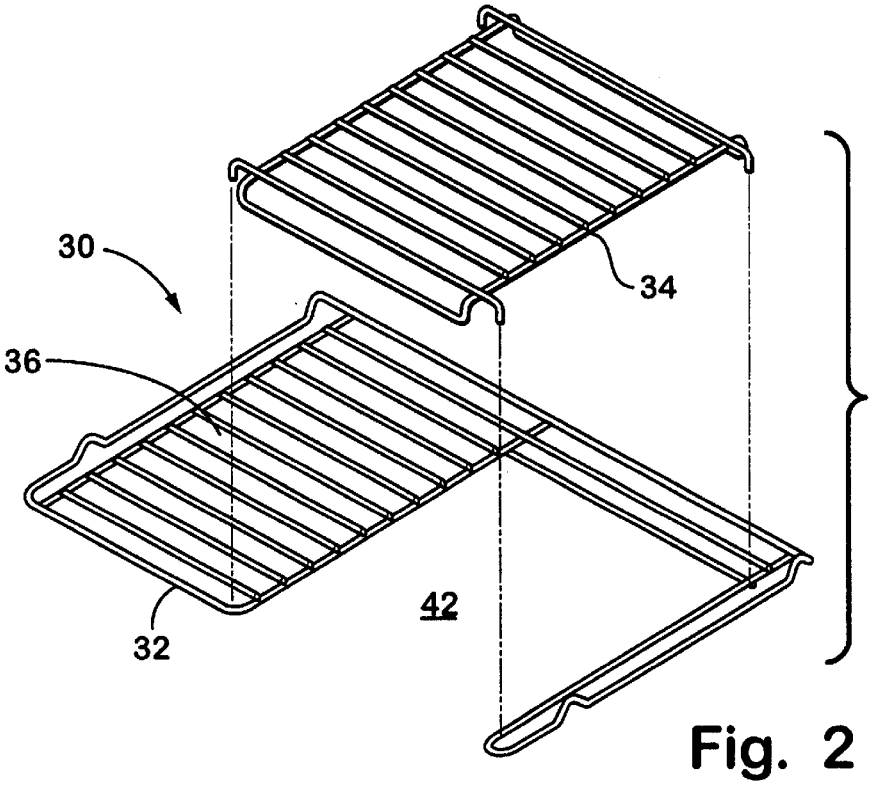
FIG. 2 is a perspective, exploded view of the upper rack assembly in accordance with a first embodiment.
Figure 3:
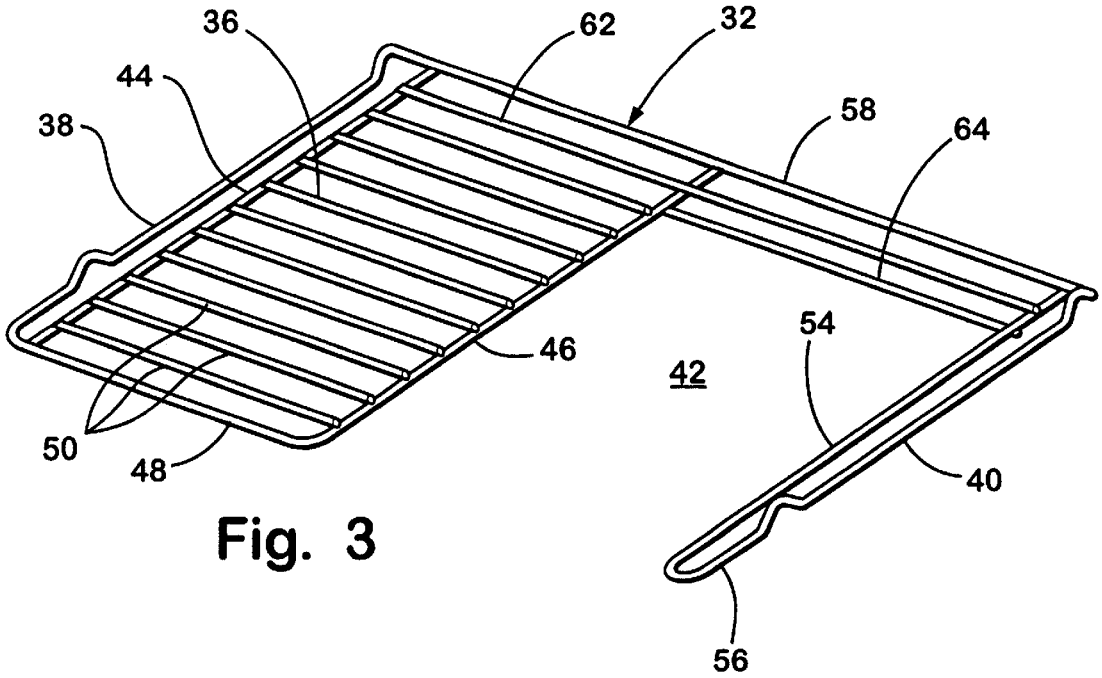
FIG. 3 is a perspective view of the main rack forming part of the upper rack assembly of FIG. 2, the main rack having a cutout area.
Figure 4:
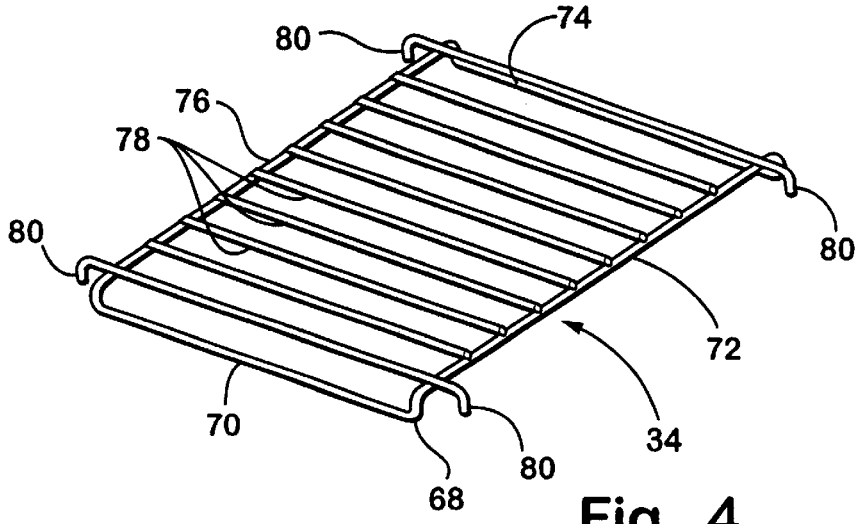
FIG. 4 is a perspective view of the insert rack forming part of the upper rack assembly of FIG. 2.
Figure 5:
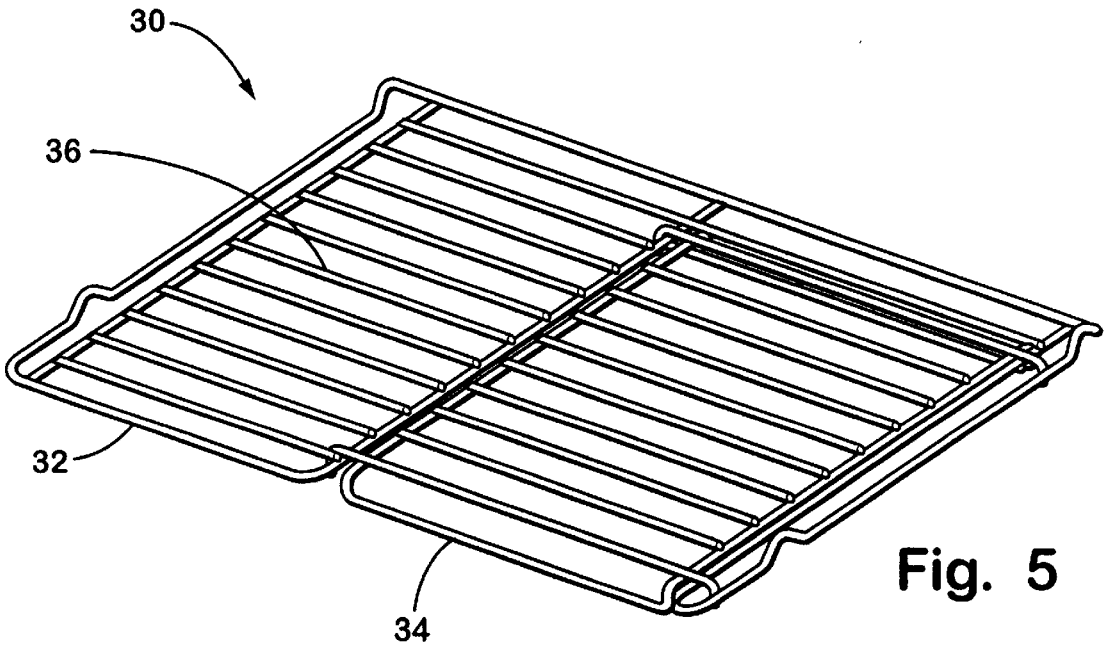
FIG. 5 is a perspective view of the upper rack assembly of FIG. 2, having the main rack and insert rack assembled together.

The main rack 32 and insert rack 34 may be combined as shown in FIGS. 1, 2 and 5. The width of the insert rack substantially corresponds to the width of the cutout area or portion 42 such that the insert rack 34 may be fit within the cutout area 42. When the insert rack 34 is positioned in the cutout area, the legs 80 of the insert rack 34 overlie the sidebars 46 and 54 which define the side portions of the cutout area 42. In this fashion, the insert rack 34 may be supported within the cutout area and may be removably attached to the main rack 32.

Figure 6:
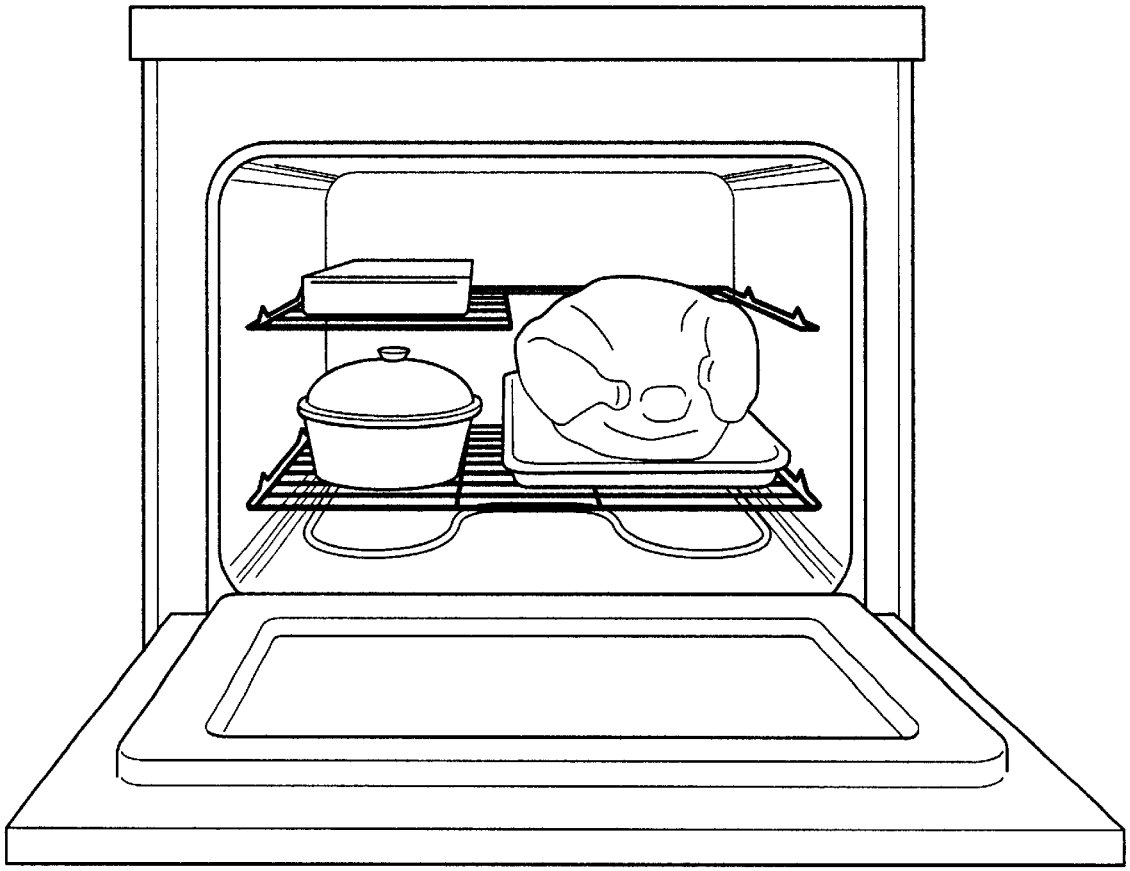
FIG. 6 is perspective view of an oven incorporating the upper rack assembly with the insert rack removed and a large item extending up into the cutout area.

In order to accommodate large items on the lower elongated rack 28 FIG. 1, the insert rack 34 may be removed. This leaves the cutout area 42 free of wires such that a large item may be supported on the lower rack 28 and extend up into the cutout area 42. At the same time, the platform area 36 can be used to support items for cooking such that the full capacity of the oven cavity 4 can be utilized. FIG. 6 illustrates a large item supported on the lower elongated rack 28 and extending into the cutout area 42.

When the insert rack 34 is not combined with the main rack 32, it can be stored or used as a cooling rack for supporting hot items or baked goods on a counter top. The locating legs 80 of the insert rack 34 are designed to form legs to support the insert rack above a counter if the insert rack is used as a cooling rack. Since the insert rack 34 is relatively small and light, its removal from the main rack can be readily accomplished with little effort.

Figure 7:
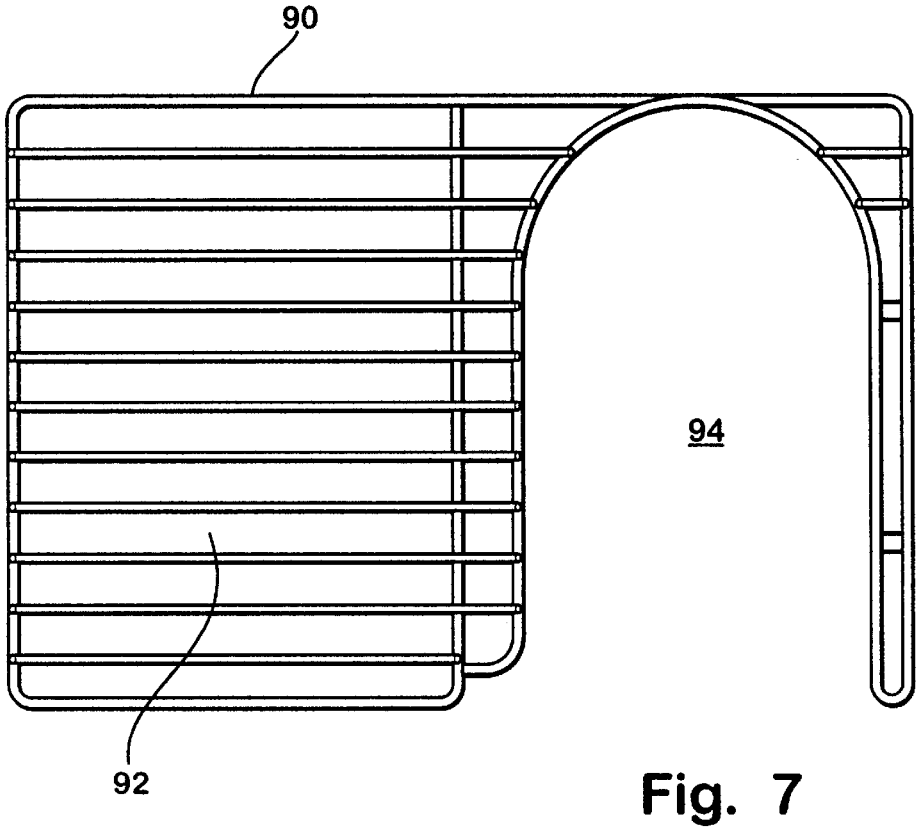
FIG. 7 is a top view of a second embodiment of the upper rack assembly of the present invention.
Figure 8:
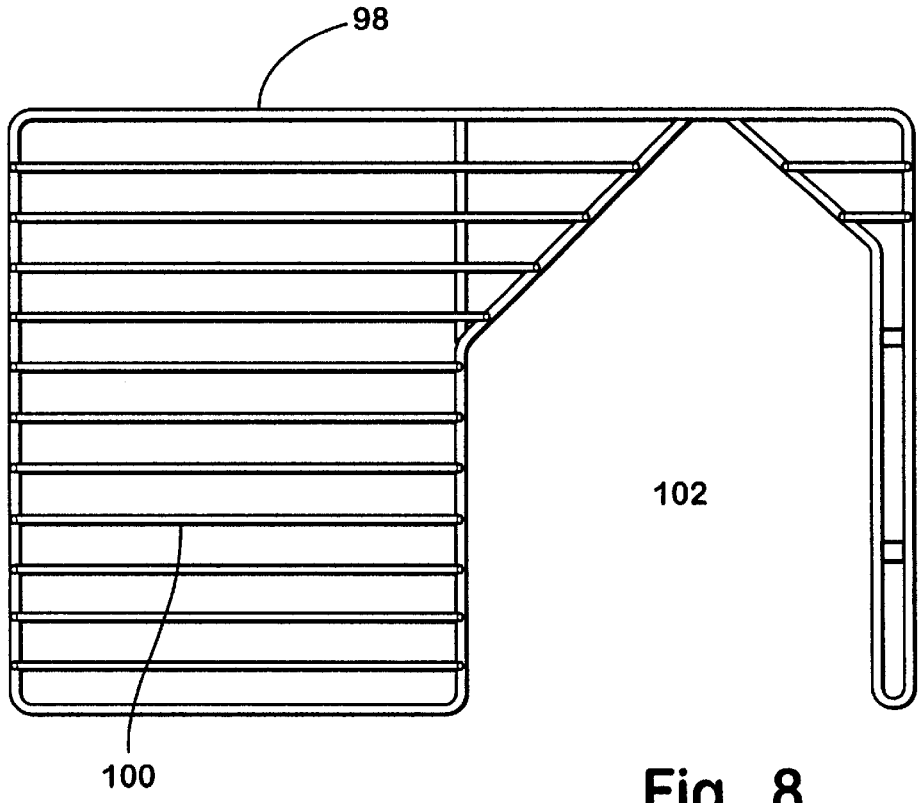
FIG. 8 is a top view of a third embodiment of the upper rack assembly of the present invention.
Figure 9:
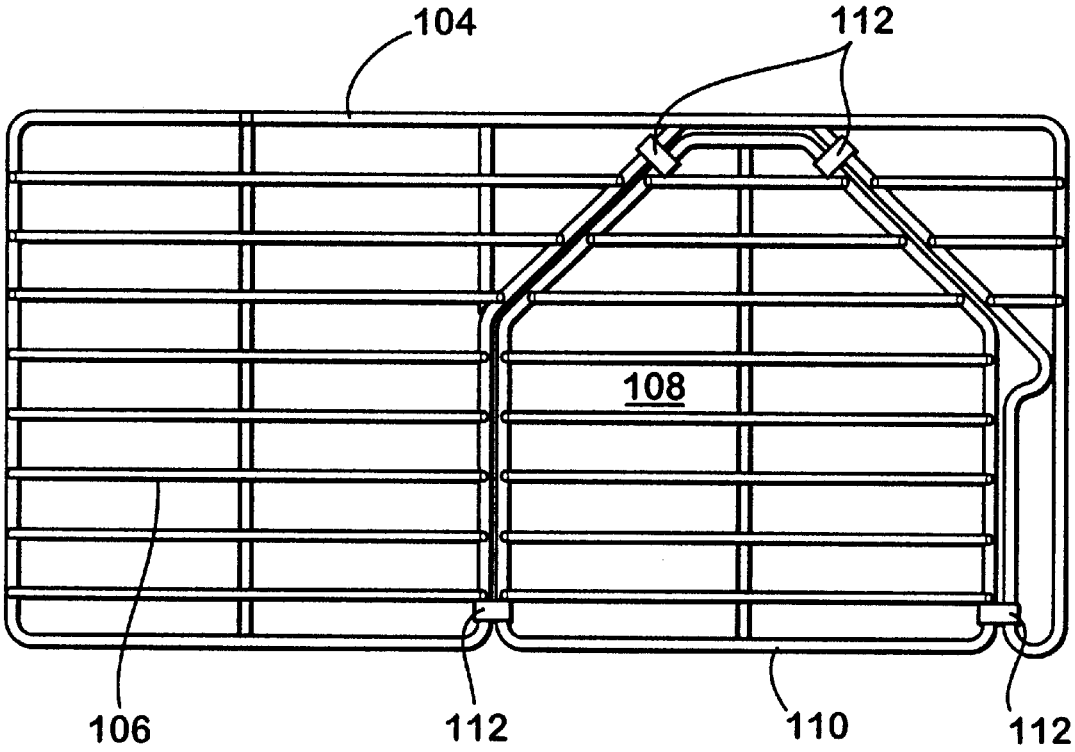
FIG. 9 is a top view of a fourth embodiment of the upper rack assembly of the present invention.

FIGS. 7–9 illustrated different embodiments of the present invention. In particular, these figures illustrate different configurations for the upper rack with a cutout. The present invention is directed to any upper rack having a platform area, a cutout area and an insert rack and these figures illustrate just some of the possible configurations that could be used.

FIG. 7 illustrates an upper rack 90 with a platform area or portion 92 and a cutout area 94 which includes a radiused rear portion. FIG. 8 illustrates an upper rack 98 with a platform portion 100 and a cutout area 102. The cutout area forms an irregular, non-rectangular polygonal shape. For the embodiments shown in FIG. 7 and FIG. 8, no insert rack is illustrated but one skilled in the art can understand that the insert racks would be configured to have a shape substantially corresponding to the shape of the cutout area.

FIG. 9 illustrates an upper rack 104 with a platform portion 106 and a cutout area 108. The cutout area forms an polygonal shape. An insert rack 110 is shown supported within the cutout area by a plurality of clips 112. The insert rack of the present invention may be supported within the cutout area of the main rack by legs or clips or other connection mechanisms.

While the present invention has been described with references to the above described embodiments, those of skill in the art will recognize that changes may be made thereto without departing from the scope of the invention as set forth in the appended claims.

We claim:

1. A rack assembly for forming a support shelf for supporting articles in an oven enclosure, comprising:

a main rack having a width substantially equal to the width of the oven enclosure, the main rack having a cutout area defined between cutout side bars and having a rear beam extending across the rear of the main rack, the rear beam being formed by a first rear wire positioned on a top side of the cutout side bars and a second rear wire positioned on a bottom side of the cutout side bars; and an insert rack having an area substantially equal to the cutout area, the insert rack being adapted to removably attach to the main rack and fit within the cutout area, and said insert rack having a plurality of legs which overlie the cutout side bars when the insert rack is fitted or installed within the cutout area such that the insert rack is supported within the cutout area and is removably attached to the main rack.

2. The rack assembly according to claim 1 wherein said rear beam is formed by welding said first rear wire in position on top of the cutout side bars and welding said second rear wire in position on the bottom of the cutout side bars to form said rear beam.

3. The rack assembly according to claim 1 wherein said main rack has a platform area adjacent said cutout area, said platform area and said cutout area each extend substantially the full depth of said main rack, and said platform area is disposed on one side of said main rack and said cutout area disposed on the other side of said main rack.

4. The rack assembly according to claim 3 wherein said platform area extends over a first portion of the width of said main rack and said cutout area extends over substantially the remaining width of said main rack, and further wherein the width of said platform area and width of said cutout area are substantially equal.

5. In an appliance including an oven cavity having top, bottom, rear and side walls, the oven cavity further having an open frontal portion and an associated width defined by the lateral distance spanning the side walls, the oven cavity side walls including a plurality of support runners arranged as associated pairs on the side walls of the oven cavity, a rack system comprising:

a lower rack having a width substantially equal to the width of the oven cavity such that the lower rack may be supported by one of the runner pairs provided on the side wall of the oven cavity;

an upper rack assembly having a width substantially equal to the width of the oven cavity, the upper rack being supported on one of the runner pairs provided on the side wall of the oven cavity, the upper rack further comprising:

a main rack having a width substantially equal to the width of the oven cavity, the main rack having a cutout area defined between cutout side bars, and having a rear beam extending across the rear of the main rack, the rear beam being formed by a first rear wire positioned on a top side of the cutout side bars and a second rear wire positioned on a bottom side of the cutout side bars, and an insert rack having an area substantially equal to the cutout area, the insert rack being adapted to removably attach to the main rack and fit within the cutout area.

6. The appliance rack system according to claim 5 wherein said rear beam is formed by welding said first rear wire in position on top of the cutout side bars and welding said second rear wire in position on the bottom of the cutout side bars to form said rear beam.

7. The appliance rack system according to claim 5 wherein said main rack has a platform area adjacent said cutout area, said platform area and said cutout area each extend substantially the full depth of said main rack, and said platform area is disposed on one side of said main rack and said cutout area disposed on the other side of said main rack.

8. The appliance rack system according to claim 7 wherein said platform area extends over a first portion of the width of said main rack and said cutout area extends over substantially the remaining width of said main rack, and further wherein the width of said platform area and the width of said cutout area are substantially equal.

* * * * *